US011333323B2

(12) United States Patent
Baronian et al.

(10) Patent No.: US 11,333,323 B2
(45) Date of Patent: May 17, 2022

(54) LIGHT EMITTING DEVICE INCLUDING VARIABLE TRANSMISSION FILM TO CONTROL INTENSITY AND PATTERN

(71) Applicant: E INK CORPORATION, Billerica, MA (US)

(72) Inventors: Antranig Baronian, Broomall, PA (US); Brian D. Bean, Newton, MA (US); George G. Harris, Woburn, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 17/084,882

(22) Filed: Oct. 30, 2020

(65) Prior Publication Data

US 2021/0048170 A1 Feb. 18, 2021

Related U.S. Application Data

(63) Continuation of application No. 16/715,822, filed on Dec. 16, 2019, now Pat. No. 10,823,373.

(60) Provisional application No. 62/780,403, filed on Dec. 17, 2018.

(51) Int. Cl.
*F21V 14/00* (2018.01)

(52) U.S. Cl.
CPC ..... *F21V 14/003* (2013.01)

(58) Field of Classification Search
CPC ..... F21V 14/003
See application file for complete search history.

(56) References Cited

U.S. PATENT DOCUMENTS

| | | | |
|---|---|---|---|
| 5,872,552 | A | 2/1999 | Gordon, II et al. |
| 5,994,840 | A | 11/1999 | Forsdyke |
| 6,130,774 | A | 10/2000 | Albert et al. |
| 6,144,361 | A | 11/2000 | Gordon, II et al. |
| 6,172,798 | B1 | 1/2001 | Albert et al. |
| 6,184,856 | B1 | 2/2001 | Gordon, II et al. |
| 6,225,971 | B1 | 5/2001 | Gordon, II et al. |
| 6,241,921 | B1 | 6/2001 | Jacobson et al. |
| 6,271,823 | B1 | 8/2001 | Gordon, II et al. |
| 6,539,654 | B2 | 4/2003 | Lin |
| 6,822,782 | B2 | 11/2004 | Honeyman |
| 6,866,760 | B2 | 3/2005 | Paolini, Jr. et al. |
| 6,909,532 | B2 | 6/2005 | Chung et al. |
| 6,922,276 | B2 | 7/2005 | Zhang et al. |

(Continued)

OTHER PUBLICATIONS

Kitamura, T. et al., "Electrical toner movement for electronic paper-like display", Asia Display/IDW'01, pp. 1517-1520, Paper HCS1-1 (2001).

(Continued)

*Primary Examiner* — Sean P Gramling
(74) *Attorney, Agent, or Firm* — Brian D. Bean

(57) ABSTRACT

A lamp includes a variable transmissive film and a light source arranged to transmit light through the variable transmissive film. The variable transmissive film includes an encapsulated dispersion containing a plurality of electrically charged particles and a fluid, the charged particles being movable by application of an electric field and capable of being switched between an open state and a diffusing state. In some embodiments, one portion of the variable transmission film is in the open state and one portion is in the closed state, thereby allowing light from the source to be shaped, e.g., into task lighting.

12 Claims, 6 Drawing Sheets

(56) References Cited

U.S. PATENT DOCUMENTS

| | | | | |
|---|---|---|---|---|
| 6,982,178 | B2 | 1/2006 | LeCain et al. | |
| 7,002,728 | B2 | 2/2006 | Pullen et al. | |
| 7,012,600 | B2 | 3/2006 | Zehner et al. | |
| 7,012,735 | B2 | 3/2006 | Honeyman | |
| 7,072,095 | B2 | 7/2006 | Liang et al. | |
| 7,075,502 | B1 | 7/2006 | Drzaic et al. | |
| 7,116,318 | B2 | 10/2006 | Amundson et al. | |
| 7,144,942 | B2 | 12/2006 | Zang et al. | |
| 7,170,670 | B2 | 1/2007 | Webber | |
| 7,173,752 | B2 | 2/2007 | Doshi et al. | |
| 7,236,291 | B2 | 6/2007 | Kaga et al. | |
| 7,312,784 | B2 | 12/2007 | Baucom et al. | |
| 7,321,459 | B2 | 1/2008 | Masuda et al. | |
| 7,327,511 | B2 * | 2/2008 | Whitesides ..... | G02F 1/16757 359/296 |
| 7,339,715 | B2 | 3/2008 | Webber et al. | |
| 7,362,485 | B2 | 4/2008 | Yamaguchi et al. | |
| 7,411,719 | B2 | 8/2008 | Paolini, Jr. et al. | |
| 7,453,445 | B2 | 11/2008 | Amundson | |
| 7,535,624 | B2 | 5/2009 | Amundson et al. | |
| 7,561,324 | B2 | 7/2009 | Duthaler et al. | |
| 7,679,814 | B2 | 3/2010 | Paolini, Jr. et al. | |
| 7,715,088 | B2 | 5/2010 | Liang et al. | |
| 7,839,564 | B2 | 11/2010 | Whitesides et al. | |
| 8,009,348 | B2 | 8/2011 | Zehner et al. | |
| 8,441,707 | B2 | 5/2013 | Lam et al. | |
| 9,279,906 | B2 | 3/2016 | Kang | |
| 9,366,935 | B2 | 6/2016 | Du et al. | |
| 9,372,380 | B2 | 6/2016 | Du et al. | |
| 9,921,451 | B2 | 3/2018 | Telfer et al. | |
| 10,062,337 | B2 | 8/2018 | Lin et al. | |
| 10,197,883 | B2 | 2/2019 | Paolini et al. | |
| 10,444,553 | B2 | 10/2019 | Laxton | |
| 2005/0002177 | A1 | 1/2005 | Ewald | |
| 2012/0169953 | A1 * | 7/2012 | Kataoka ..... | H05B 47/175 349/36 |
| 2014/0011913 | A1 | 1/2014 | Du et al. | |
| 2015/0005720 | A1 | 1/2015 | Zang | |
| 2016/0012710 | A1 | 1/2016 | Lu et al. | |

OTHER PUBLICATIONS

Yamaguchi, Y et al., "Toner display using insulative particles charged triboelectrically", Asia Display/IDW '01, pp. 1729-1730, Paper AMD4-4 (2001).

* cited by examiner

LIGHT EMITTING DEVICE INCLUDING VARIABLE TRANSMISSION FILM TO CONTROL INTENSITY AND PATTERN

RELATED APPLICATIONS

This application is a continuation of U.S. patent application Ser. No. 16/715,822, filed Dec. 16, 2019, now U.S. Pat. No. 10,823,373, which claimed priority to U.S. Provisional Patent Application No. 62/780,403, filed Dec. 17, 2019. All patents, applications, and publications discussed herein are incorporated by reference in their entireties.

BACKGROUND OF INVENTION

The present invention relates to light emitting devices. Specifically, the present invention relates to light emitting devices that utilize a variable transmission film to regulate the light output of the device.

Energy efficiency of light emitting devices, such as household incandescent bulbs, is a concern. One proposed solution for improving energy efficiency is to replace the light sources within the devices with light emitting diodes (LEDs), which consume less energy. The light emitted by an LED does not vary with changing voltage. Therefore, for dimming applications, LED bulbs are dimmed either through pulse-width-modulation (PWM) or analog dimming. PWM is achieved by cycling the bulb on and off from a few hundred to hundreds of thousands times per second. The human eye perceives the LED as dim depending on the number of cycles. Analog dimming is achieved by varying the current delivered to the LED.

The disadvantage of PWM is that it can be limited in the low light levels it is able to achieve, and analog dimming results in inconsistent light color, i.e. the color changes based on the current supplied to the LED.

Thus, there is a need for improved light emitting devices.

SUMMARY OF INVENTION

In one aspect, a lamp comprises a variable transmissive film and a light source arranged to transmit light through the variable transmissive film, the variable transmissive film comprising an encapsulated dispersion containing a plurality of electrically charged particles and a fluid, the charged particles being movable by application of an electric field and capable of being switched between an open state and a closed state.

These and other aspects of the present invention will be apparent in view of the following description.

BRIEF DESCRIPTION OF DRAWINGS

The drawing Figures depict one or more implementations in accord with the present concepts, by way of example only, not by way of limitations. The drawings are not to scale. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details.

Generally, the light emitting devices according to the various embodiments of the present invention include a variable transmission film configured to cover the light sources within the devices, so that variable transmission film may be used to control the amount of light emitted from the device. This provides an alternative method of dimming the devices that may include LED light sources and thereby avoids the need for PWM or analog dimming. Other embodiments of light emitting devices described below utilize a variable transmission film to eliminate the need for mechanical components to focus the light, such as a task light or a spotlight.

Figure 1:
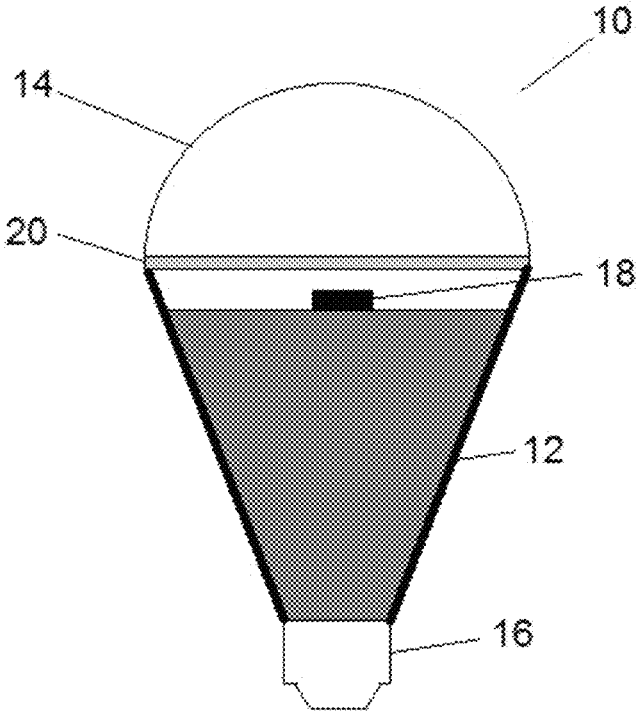
FIG. 1 is a schematic cross-sectional side view of a light emitting device according to an embodiment of the invention.

Referring now specifically to FIG. 1, a light emitting device 10 according to a first embodiment of the invention is illustrated. The device 10 includes a housing 12, a cover 14 attached to one end of the housing, a light transmissive film 20, and a terminal 16. The light source 18 is located on or within the housing 12, as well as the components necessary for controlling the delivery of energy to the light source 18 and the light transmissive film 20. The light transmissive film 20 is preferably located and/or configured, such that most, if not all of the light emitted by the light source 18 is transmitted through the film 20 prior to being transmitted through the cover 14. The light source 18 preferably consumes little energy and generates little heat, such as an LED. In a first embodiment of the present invention, the cover 14 preferably comprises a light diffusive material, such as a plastic or glass containing a white pigment. The terminal 16 may be located on an opposing end of the housing 12 relative to the cover 14 and configured to connect to a power source. For example, the terminal 16 may be threaded for installation in a typical light fixture, such as a lamp.

The light transmissive film 20 is preferably a variable transmissive film, more preferably, a particle-based electrophoretic film, such as those described in U.S. Pat. No. 7,327,511. The '511 patent describes variable transmission devices including charged pigment particles that are distributed in a non-polar solvent and encapsulated. These variable transmission devices can be driven to an open state with an AC driving voltage whereby the charged pigment particles are driven to the capsule walls, which is described in greater detail below. Accordingly, such variable transmission devices are useful when it is desirable to alter the transmissivity at will.

The '511 patent describes various factors which are important in adapting electrophoretic media for optimum performance in variable transmission devices. One important factor is bistability. The terms "bistable" and "bistability" are used herein in their conventional meaning in the art to refer to elements having first and second display states differing in at least one optical property, and such that after any given element has been driven, by means of an addressing pulse of finite duration, to assume either its first or second state, after the addressing pulse has terminated, that state will persist for at least several times, for example at least four times, the minimum duration of the addressing pulse required to change the state of the element. It is shown in U.S. Pat. No. 7,170,670 that some particle-based electrophoretic displays capable of gray scale are stable not only in their extreme black and white states but also in their intermediate gray states. This type of display is properly called "multi-stable" rather than bistable, although for convenience the term "bistable" may be used herein to cover both bistable and multi-stable elements.

Referring now to FIG. 1, a particle-based electrophoretic film 20 that may be incorporated in the various embodiments of the present invention is illustrated. The top electrode layer 22, as illustrated, comprises a light transmissive conductive material and an optional protective substrate. The term "light-transmissive" is used herein with respect to the various layers of the display to mean that the layer thus designated transmits sufficient light to enable an observer, looking through that layer, to observe the change in display states of the electro-optic medium, which will normally be viewed through the electrically-conductive layer and adjacent substrate (if present); in cases where the electro-optic medium displays a change in reflectivity at non-visible wavelengths, the term "light-transmissive" should of course be interpreted to refer to transmission of the relevant non-visible wavelengths.

Below the top electrode layer 22 is a layer of a particle-based electrophoretic medium 26. The electrophoretic materials used in the various embodiments of the present invention are preferably solid in the sense that the materials have solid external surfaces, although the materials may, and often do, have internal liquid- or gas-filled spaces. The electrophoretic material is also preferably encapsulated and bistable.

Figure 2:
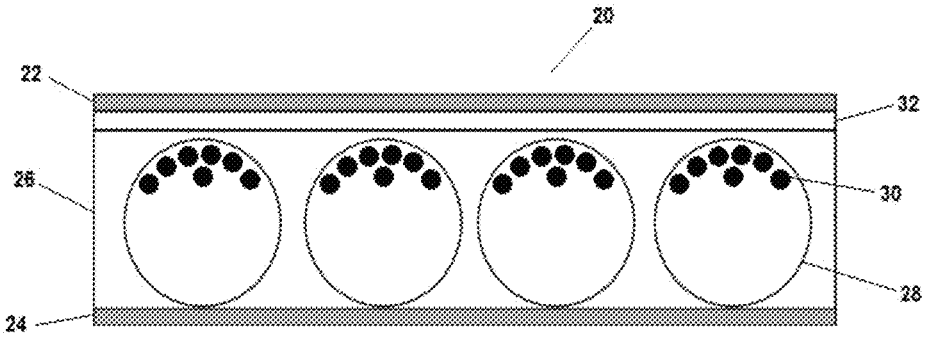
FIG. 2 is a schematic cross-sectional side view of a variable transmissive film in a closed state that may be incorporated into the various embodiments of the present invention.

The variable transmissive film 20 preferably has two electrode layers as illustrated in FIG. 2 wherein a first light transmissive electrode layer 22 and second light transmissive electrode layer 24 are located on opposing sides of the layer of electrophoretic medium 26. The electrode layers apply a potential across the layer of electrophoretic medium, so that the medium switches between an open state (light-transmissive) and a closed state (opaque) upon application of an electric field in a so-called "shutter mode." See, for example, U.S. Pat. Nos. 5,872,552; 6,130,774; 6,144,361; 6,172,798; 6,271,823; 6,225,971; and 6,184,856.

The electrode layers may be provided in several forms. For example, the electrode layer may be a continuous layer of light transmissive conductive material, such as indium tin oxide, that is optionally coated onto a light transmissive protective sheet or substrate, such as glass or a plastic, e.g. polyethylene terephthalate. Alternatively, the electrodes may be divided into a plurality of segments of conductive material, such that each segment is independently controllable. In another embodiment, one or both of the electrode layers may be patterned to define the pixels. For example, one electrode layer may be patterned into elongate row electrodes and the other into elongate column electrodes running at right angles to the row electrodes, the pixels being defined by the intersections of the row and column electrodes. Alternatively, and more commonly, one electrode layer has the form of a single continuous electrode and the other electrode layer is patterned into a matrix of pixel electrodes, each of which may be independently addressed and defines one pixel.

As previously mentioned in particle-based electrophoretic media, a plurality of charged particles move through a fluid under the influence of an electric field. As illustrated in FIG. 2, when a DC field is applied to the film 20, the particles 30 within a capsule 28 move toward the viewing surface, thereby changing the optical state to opaque and preventing light from being transmitted through the layer of electrophoretic medium 26. It is preferable that the particles are dark in color, more preferably black, so that the opaque state of the film will more effectively shield the light emitted from the light source 18.

Figure 3:
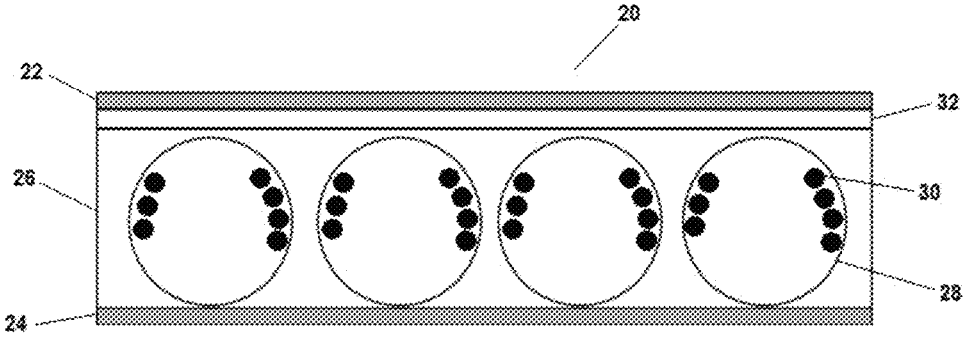
FIG. 3 is a schematic cross-sectional side view of the variable transmissive film of FIG. 2 in an open state.

When an alternating electric field is applied to one of the electrodes, the charged pigment particles 30 are driven to the side walls of the capsule 28, resulting in an aperture through the capsule 28 for the transmission of light, as illustrated in FIG. 3. In addition to the charged particles 30, the capsule contains a fluid, preferably a non-polar solvent that may comprise charge control agents and/or stabilizers, such that the optical state (open/closed) can be maintained for long periods of time (weeks) without the need to maintain the electric field. As a result, the film may be "switched" only a few times a day and consume very little power.

Although not illustrated, the various embodiments of the present invention may include an optional light transmissive color filter that is incorporated either in the cover 14 or the variable transmissive film 20. Alternatively, the charged particles and/or solvent within the encapsulated dispersions in the electrophoretic medium 16 may be colored or the light source 18 may emit a colored light, if it is desired to provide devices that emit light having various colors.

As previously mentioned, the housing of the light emitting devices made according to the various embodiments of the invention may include the components necessary for controlling the power delivered to the light source and variable transmissive film. The housing may also contain a power source, such as a replaceable and/or rechargeable battery; thereby eliminating the need for an external terminal for connection to an outside power source. In some embodiments, the lighting device may comprise a controller that uses the same power input as the light source to control the driving of the electrophoretic medium. The controller may be programmed to allow the user to control the frequency and voltage to control the amount of light that passes through the variable transmissive film. For example, for a household plug-in AC powered device, such as a lamp or light bulb, a simple controller could be used which rectifies a 120VAC, 60 Hz input signal and then outputs a microprocessor controlled 120V variable frequency signal. The light emitting device may also comprise other components for remotely controlling its operation, such as an RF antenna and transceiver for WiFi, Bluetooth, Zigbee or other RF protocol, and an IR receiver or transceiver, so that the light emitting device may be controlled with a handheld electronic device, such as a laptop, tablet, or mobile telephone.

In a second embodiment of the present invention, the cover 14 in the device 10 illustrated in FIG. 1 may be transparent, and the light source 18 and/or housing 12 configured to focus the light into a narrow beam, such as a task light. The charged particles 30 in the encapsulated electrophoretic medium 26 may then comprise white, diffusive particles. When the variable transmissive film 20 is in an open state, such as the light transmissive state illustrated in FIG. 3, the device 10 will operate as a task light. However, when the variable transmissive film 20 is switched to a closed state, such as the opaque state illustrated in FIG. 2, the white charged particles 30 will diffuse the light emitted by the light source 18, thereby providing a "frosted" cover. This provides a method of switching between task lighting and ambient lighting without the need for any mechanical components for re-focusing the light emitted from the light source.

In a third embodiment of the present invention, the light emitting device may be modified, such that the variable transmissive film and the cover of the light emitting device are combined into a single component. For example, referring to FIGS. 4A and 4B, the cover 14 may provide a light transmissive curved substrate on which a first layer of conductive material is applied to an inner surface of the cover 14 to provide a first electrode layer 22, a layer of electrophoretic medium 26 is applied over the first electrode layer 22, and a second layer of conductive material is applied over the layer of electrophoretic medium 26 to form a second electrode layer 24. Alternatively, the successive layer may be applied in order to the outside surface of the cover 14. Also an optional protective layer may be applied over the top electrode layer.

In order to separate the first and second electrode layers 22, 24 to prevent an electrical short that may circumvent the application of an electric field to the electrophoretic medium and to provide contacts to connect the electrode layers 22, 24 to a power source and the controllers within the housing 12, a dielectric material 28*a*, 28*b* may also be applied on at least a portion of the area of the cover 14 and or the layers of the film. For example, referring again to FIG. 4A, prior to application of the first electrode layer 22, a first dielectric material 28*b* may be applied to a portion of the inner surface near an edge of the cover 14. After application of the first electrode layer 22 to the inner surface of the cover 14, a second dielectric material 28*a* may be applied over a similarly sized area over the first electrode layer 22 near the edge, but on an opposing side of the cover 14. The remaining layers of electrophoretic medium 26 and second electrode layer 24 may then be applied over the first electrode layer 22. As a result, the first and second electrode layers 22, 24 are separated by the dielectric material 28*a*, 28*b* and the electrophoretic medium 26. The portion of the conductive material of electrode layer 24 immediately adjacent to the first dielectric material 28*b* may provide a first connection point 23*b*, and the portion of the conductive material of electrode layer 22 immediately adjacent to the second dielectric material 28*a* may provide a second connection point 23*a*. Any highly resistive/insulating material known to those of skill in the art may be used as the dielectric material, such as a non-conductive polymer, for example.

Figure 4A:
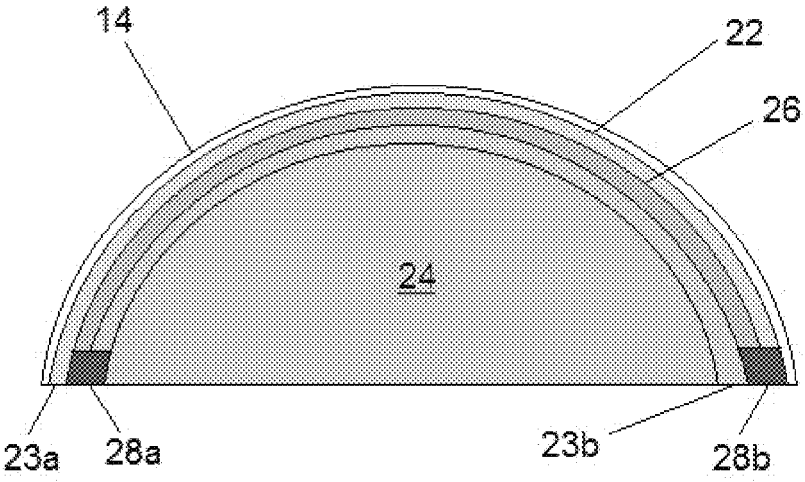
FIG. 4A is a schematic cross-sectional side view of a cover for a light emitting device according to another embodiment of the invention.
Figure 4B:
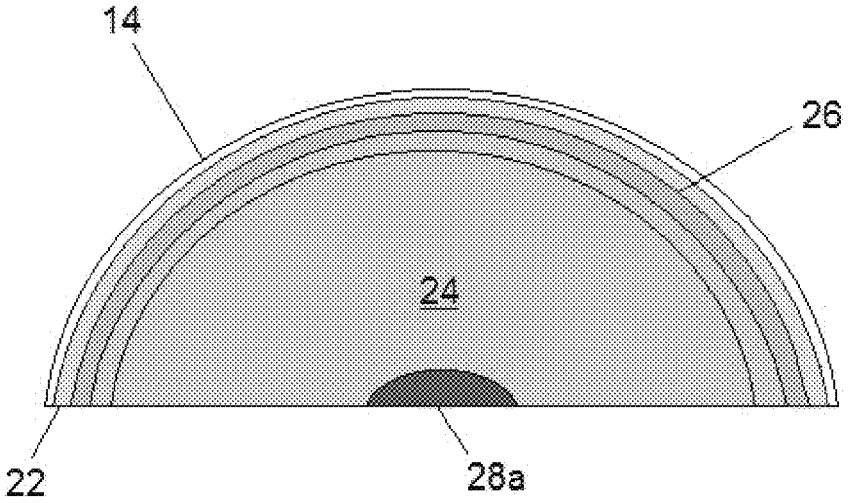
FIG. 4B is a schematic cross-sectional side view of the cover of FIG. 4A rotated 90 degrees.
Figure 4C:
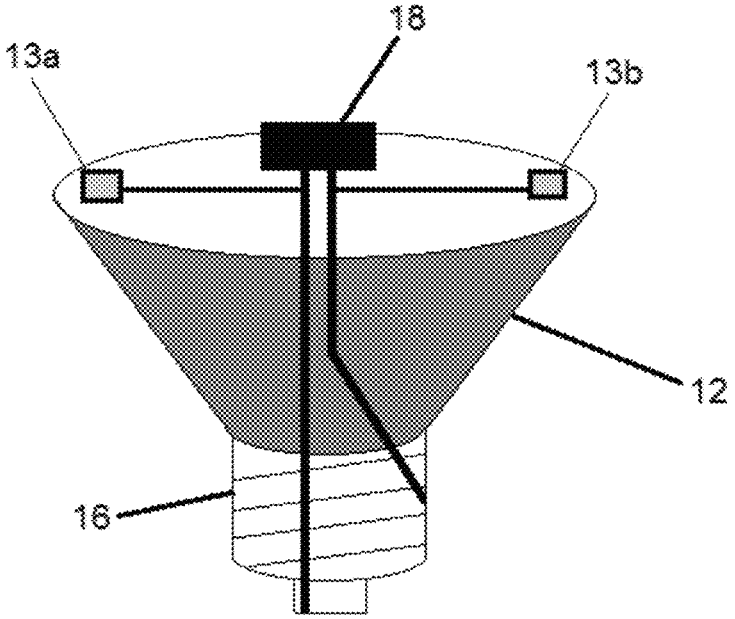
FIG. 4C is a schematic top perspective view of an embodiment of a housing for receiving the cover of FIG. 4A.

The cover 14 illustrated in FIGS. 4A and 4B may then be electrically connected in parallel with a light source 18 with an appropriately designed housing, such as the embodiment illustrated in FIG. 4C. In FIG. 4C, two contact pads 13*a*, 13*b* are located on a top surface with the light source 18. The width of the contact pads 13*a*, 13*b* is preferably less than the width of the dielectric material 28*a*, 28*b* applied to the edge of the cover 14 to ensure that only one on connection points 23*a*, 23*b* is in electrical contact with one of contact pads 13*a*, 13*b*. Upon connecting terminal 16 to a power source, electricity may be delivered in parallel to the cover 14 and the light source 18. To ensure that the cover 14 is correctly installed onto the housing 12, the outside surface of the cover 14 may be marked with some indicia (not shown) in the vicinity of the connection points 23*a*, 23*b* with corresponding indicia (not shown) on the outer surface of the housing 12 in the vicinity of the contact pads 13*a*, 13*b*.

Figure 5A:
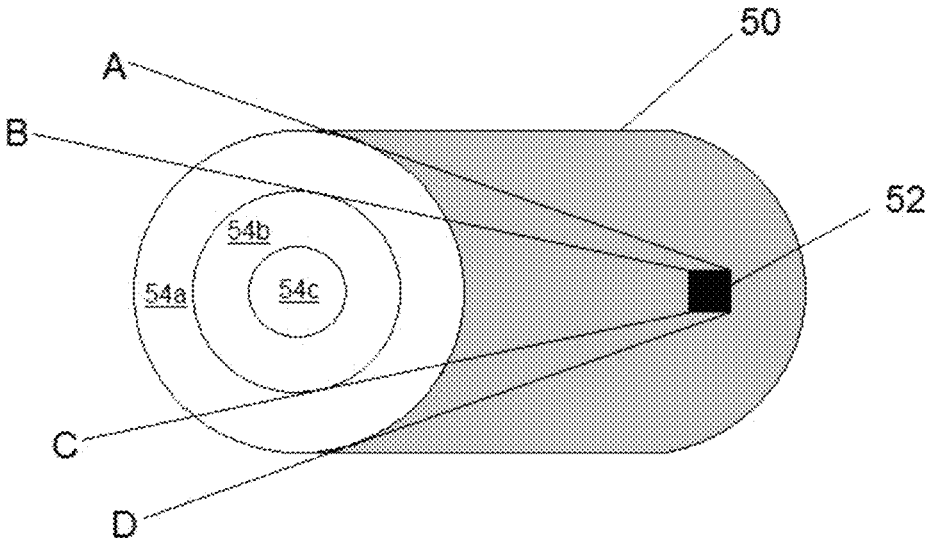
FIG. 5A is a schematic side perspective view of a light emitting device according to yet another embodiment of the present invention in a first optical state.
Figure 5B:
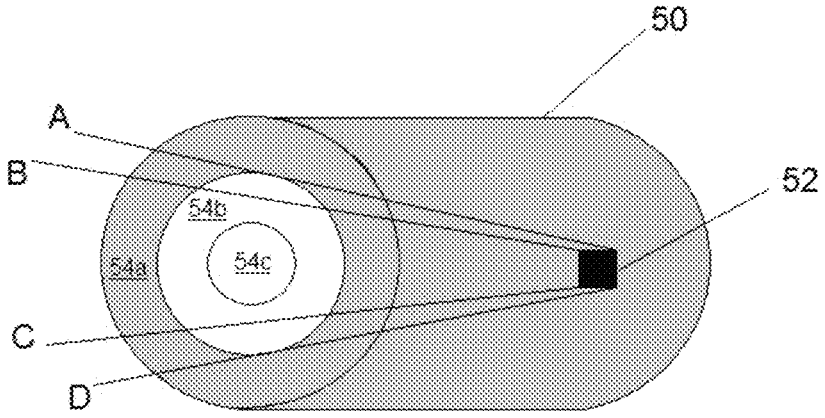
FIG. 5B is a schematic side perspective view of the light emitting device of FIG. 5A in a second optical state.
Figure 5C:
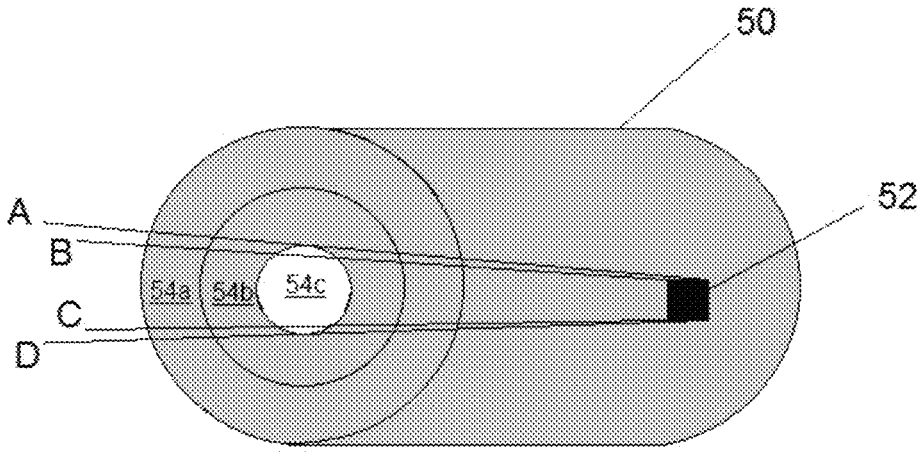
FIG. 5C is a schematic side perspective view of the light emitting device of FIG. 5A in a third optical state.

In a fourth embodiment of the present invention, the variable transmissive film may include a plurality of independently controllable segments that may allow the light emitted from a light source to be focused, such as a spot light. For example, referring to FIGS. 5A to 5C, a light emitting device 50 may include a light source 52 and a variable transmissive film comprising a plurality of independently controllable segments 54*a*, 54*b*, 54*c*. The segments 54*a*, 54*b*, 54*c* may be configured as a series of concentric circles, for example. In FIG. 5A, the variable transmissive film is in an open state, thereby allowing the maximum spread angle of light rays A, B, C, D emitted by light source 52. In FIG. 5B, the outermost segment 54*a* is switched to an opaque state, while the inner segments 54*b*, 54*c* remain in an open state causing a reduction in the angle of light emitted by light source 52. Finally, in FIG. 5C the outermost segments 54*a*, 54*b* are switched to an opaque state, while the central segment 54*c* is in an open state providing the most acute spread angle for light rays A, B, C, D. Increasing the number of segments will provide a finer control of the spread angle of light emitted by the light source. The segmented variable transmissive film may be used in combination with a variable transmissive film containing a diffusive material, such as the film previously described in the second embodiment, to provide a light emitting device capable of switching between an ambient light and a task light.

Figure 6A:
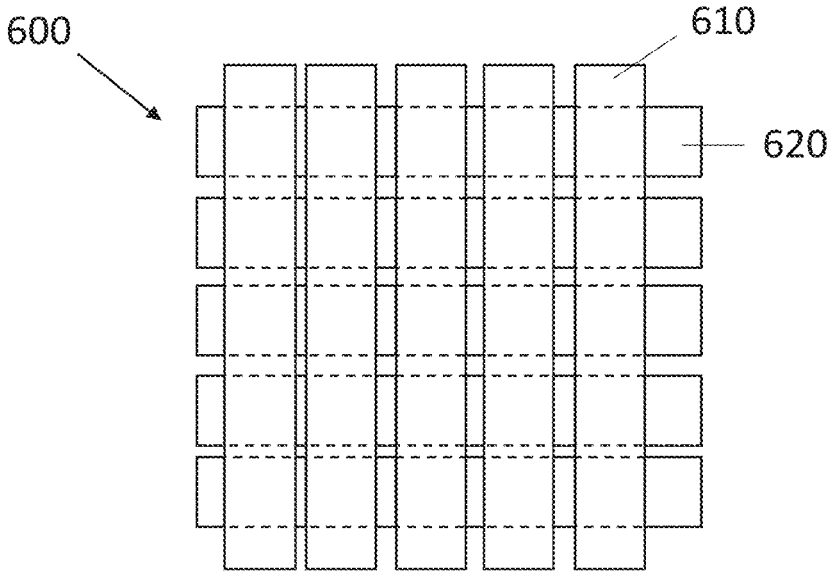
FIG. 6A is an illustration of a passive matrix of electrodes that allows pixel-like control of a variable transmission file coupled to a light source.
Figure 6B:
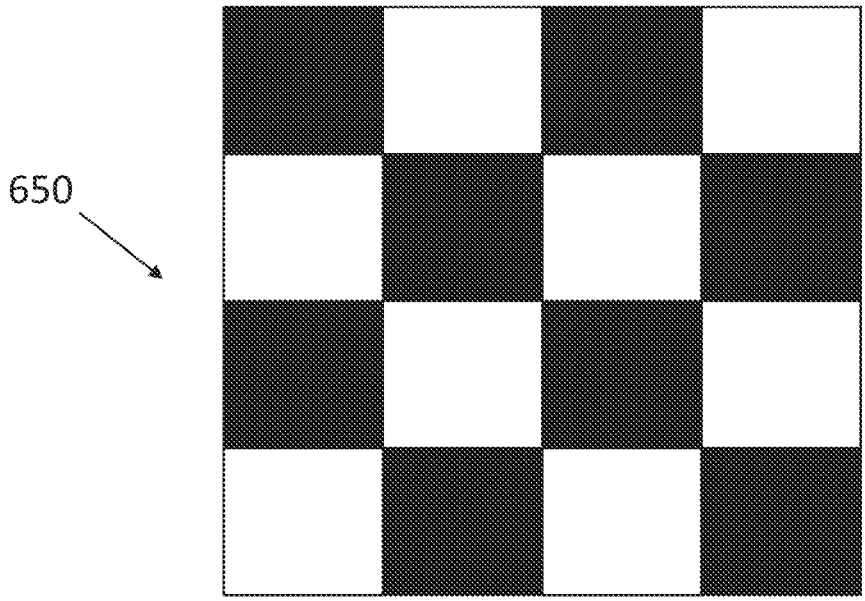
FIG. 6B shows an exemplary light pattern that can be created with the use of passive matrix drive electrodes illustrated in FIG. 6A.

Additionally, a system of segmented electrodes can be used to create a passive drive matrix 600 as shown in FIG. 6A. In FIG. 6A, a first set of independently-controllable column electrodes 610 are placed over a layer of encapsulated dispersion containing a plurality of electrically charged particles and a fluid (not shown in FIG. 6A). On the opposed side of the encapsulated dispersion is placed a second set of independently-controllable row electrodes 620. With careful coordination of the voltage states on the electrodes (610, 620) as well as tuning of the electrically-charged particles, it is possible to inexpensively create pixels of shuttered electrophoretic material. Greater details of driving electrophoretic displays with passive matrix can be found in, e.g., U.S. Pat. Nos. 6,909,532, 7,362,485, and 10,062,337, all of which are incorporated by reference in their entireties. The pixels can be large, e.g., on the order of a 1"×1" square, or small, on the order of a 100 μm×100 μm square or somewhere in between. When the resulting variable transmission film is coupled to the light source, it is possible to create a pattern of light and dark squares 650, as shown in FIG. 6B. In some embodiments, using a large number of pixels, it is possible to make patterns with the light transmitting through the variable transmission film, for example text characters.

Figure 7A:
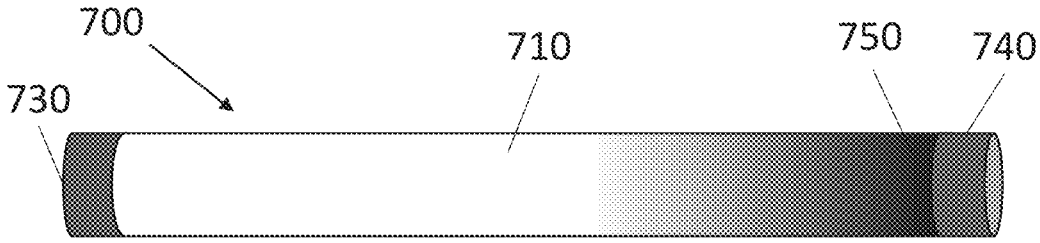
FIGS. 7A and 7B shows two different states for a fluorescent tube lamp that has been covered with a variable transmission film and driven with a time-dependent voltage across the face of the lamp. The resulting effect is to create a pulse of dark that moves back and forth along the length of the lamp. Other effects can be created with differing time-dependent driving voltages.
Figure 7B:
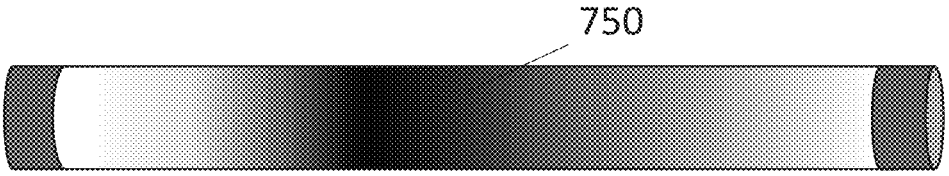

Another driving alternative uses so-called "wave switching" to create moving optical patterns, such as shown in FIGS. 7A and 7B. A wave switching lamp 700 includes a light source, for example, a fluorescent light bulb, that is coated with a variable transmission film 710 of the type described in the previous examples. In the embodiment of FIGS. 7A and 7B, the controller is coupled to the two distal ends 730 and 740 of the variable transmission film 710, thereby allowing a time-dependent voltage to be applied across the length of the variable transmission film 710. As a result, a time-dependent area of light absorption 750 appears to move back and forth down the length of the lamp 700. The details of this "wave switching" phenomenon and suitable waveforms are described in U.S. Pat. No. 10,197,883, which is incorporated by reference herein in its entirety.

As noted above, the electrophoretic medium used in the various embodiments of the present invention is preferably an encapsulated electrophoretic medium. Numerous patents and applications assigned to or in the names of the Massachusetts Institute of Technology (MIT), E Ink Corporation, E Ink California, LLC and related companies describe various technologies used in encapsulated electrophoretic and other electro-optic media. Encapsulated electrophoretic media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. Alternatively, the charged particles and the fluid are not encapsulated within microcapsules but instead are retained within a plurality of cavities formed within a carrier medium, typically a polymeric film. The technologies described in these patents and applications include:

(a) Electrophoretic particles, fluids and fluid additives; see for example U.S. Pat. Nos. 7,002,728 and 7,679,814;
(b) Capsules, binders and encapsulation processes; see for example U.S. Pat. Nos. 6,922,276 and 7,411,719;
(c) Microcell structures, wall materials, and methods of forming microcells; see for example U.S. Pat. Nos. 7,072,095 and 9,279,906;
(d) Methods for filling and sealing microcells; see for example U.S. Pat. Nos. 7,144,942 and 7,715,088;
(e) Films and sub-assemblies containing electro-optic materials; see for example U.S. Pat. Nos. 6,982,178 and 7,839,564;
(f) Backplanes, adhesive layers and other auxiliary layers and methods used in displays; see for example U.S. Pat. Nos. 7,116,318 and 7,535,624;
(g) Color formation and color adjustment; see for example U.S. Pat. Nos. 7,075,502 and 7,839,564;
(h) Methods for driving displays; see for example U.S. Pat. Nos. 7,012,600 and 7,453,445;
(i) Applications of displays; see for example U.S. Pat. Nos. 7,312,784 and 8,009,348; and
(j) Non-electrophoretic displays, as described in U.S. Pat. No. 6,241,921 and U.S. Patent Applications Publication No. and 2015/0277160; and applications of encapsulation and microcell technology other than displays; see for example U.S. Patent Application Publications Nos. 2015/0005720 and 2016/001271.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

An encapsulated electrophoretic medium typically does not suffer from the clustering and settling failure mode of traditional electrophoretic media and provides further advantages, such as the ability to print or coat the display on a wide variety of flexible and rigid substrates, such as the curved cover 14 of the embodiment illustrated in FIGS. 4A and 4B. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.)

Whether encapsulated in a microcapsule, microcell, or droplet within a continuous polymeric phase, the dispersions containing the plurality of charged particles also contain a fluid, as well as other optional additives. The dispersion fluid is preferably a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Pat. Nos. 7,321,459 and 7,236,291.

The charged pigment particles are preferably either a black or dark color for dimming applications or preferably white to provide variable "frosted" films; however, the pigments may be of a variety of colors and compositions. Additionally, the charged pigment particles may be functionalized with surface polymers to improve state stability. Such pigments are described in U.S. Patent Publication No. 2016/0085132, which is incorporated by reference in its entirety. For example, if the charged particles are of a white color, they may be formed from an inorganic pigment such as $TiO_2$, $ZrO_2$, ZnO, $Al_2O_3$, $Sb_2O_3$, $BaSO_4$, $PbSO_4$ or the like. They may also be polymer particles with a high refractive index (>1.5) and of a certain size (>100 nm) to exhibit a white color, or composite particles engineered to have a desired index of refraction. Black charged particles, they may be formed from CI pigment black 26 or 28 or the like (e.g., manganese ferrite black spinel or copper chromite black spinel) or carbon black. Other colors (non-white and non-black) may be formed from organic pigments such as CI pigment PR254, PR122, PR149, PG36, PG58, PG7, PB28, PB15:3, PY83, PY138, PY150, PY155 or PY20. Other examples include Clariant Hostaperm Red D3G 70-EDS, Hostaperm Pink E-EDS, PV fast red D3G, Hostaperm red D3G 70, Hostaperm Blue B2G-EDS, Hostaperm Yellow H4G-EDS, Novoperm Yellow HR-70-EDS, Hostaperm Green GNX, BASF Irgazine red L 3630, Cinquasia Red L 4100 HD, and Irgazin Red L 3660 HD; Sun Chemical phthalocyanine blue, phthalocyanine green, diarylide yellow or diarylide AAOT yellow. Color particles can also be formed from inorganic pigments, such as CI pigment blue 28, CI pigment green 50, CI pigment yellow 227, and the like. The surface of the charged particles may be modified by known techniques based on the charge polarity and charge level of the particles required, as described in U.S. Pat. Nos. 6,822,782, 7,002,728, 9,366,935, and 9,372,380 as well as US Publication No. 2014-0011913, the contents of all of which are incorporated herein by reference in their entireties.

The particles may exhibit a native charge, or may be charged explicitly using a charge control agent, or may acquire a charge when suspended in a solvent or solvent mixture. Suitable charge control agents are well known in the art; they may be polymeric or non-polymeric in nature or may be ionic or non-ionic. Examples of charge control agent may include, but are not limited to, Solsperse 17000 (active polymeric dispersant), Solsperse 9000 (active polymeric dispersant), OLOA® 11000 (succinimide ashless dispersant), Unithox 750 (ethoxylates), Span 85 (sorbitan trioleate), Petronate L (sodium sulfonate), Alcolec LV30 (soy lecithin), Petrostep B100 (petroleum sulfonate) or B70 (barium sulfonate), Aerosol OT, polyisobutylene derivatives or poly(ethylene co-butylene) derivatives, and the like. In addition to the suspending fluid and charged pigment particles, internal phases may include stabilizers, surfactants and charge control agents. A stabilizing material may be adsorbed on the charged pigment particles when they are dispersed in the solvent. This stabilizing material keeps the particles separated from one another so that the variable transmission medium is substantially non-transmissive when the particles are in their dispersed state.

As is known in the art, dispersing charged particles (typically a carbon black, as described above) in a solvent of low dielectric constant may be assisted by the use of a surfactant. Such a surfactant typically comprises a polar "head group" and a non-polar "tail group" that is compatible with or soluble in the solvent. In the present invention, it is preferred that the non-polar tail group be a saturated or unsaturated hydrocarbon moiety, or another group that is soluble in hydrocarbon solvents, such as for example a poly(dialkylsiloxane). The polar group may be any polar organic functionality, including ionic materials such as ammonium, sulfonate or phosphonate salts, or acidic or basic groups. Particularly preferred head groups are carboxylic acid or carboxylate groups. Stabilizers suitable for use with the invention include polyisobutylene and polystyrene. In some embodiments, dispersants, such as polyisobutylene succinimide and/or sorbitan trioleate, and/or 2-hexyldecanoic acid are added.

The fluids used in the variable transmission media of the present invention will typically be of low dielectric constant (preferably less than 10 and desirably less than 3). The fluids are preferably solvents that have low viscosity, relatively high refractive index, low cost, low reactivity, and low vapor pressure/high boiling point. Examples of solvents include, but are not limited to, aliphatic hydrocarbons such as heptane, octane, and petroleum distillates such as Isopar® (Exxon Mobil) or Isane® (Total); terpenes such as limonene, e.g., 1-limonene; and aromatic hydrocarbons such as toluene. A particularly preferred solvent is limonene, since it combines a low dielectric constant (2.3) with a relatively high refractive index (1.47). The index of refraction of the internal phase may be modified with the addition of the index matching agents. For example, the aforementioned U.S. Pat. No. 7,679,814 describes an electrophoretic medium suitable for use in a variable transmission device in which the fluid surrounding the electrophoretic particles comprises a mixture of a partially hydrogenated aromatic hydrocarbon and a terpene, a preferred mixture being d-limonene and a partially hydrogenated terphenyl, available commercially as Cargille® 5040 from Cargille-Sacher Laboratories, 55 Commerce Rd, Cedar Grove, N.J. 07009. For some of the embodiments of the present invention, such as the spotlight embodiment illustrated in FIGS. 5A to 5C, it is preferred that the refractive index of the encapsulated dispersion match as closely as possible to that of the encapsulating material to reduce haze. In most instances, it is beneficial to have an internal phase with an index of refraction between 1.51 and 1.57 at 550 nm, preferably about 1.54 at 550 nm.

In a preferred embodiment of the present invention, the encapsulated fluid may comprise one or more nonconjugated olefinic hydrocarbons, preferably cyclic hydrocarbons. Examples of nonconjugated olefinic hydrocarbons include, but are not limited to terpenes, such as limonene; phenyl cyclohexane; hexyl benzoate; cyclododecatriene; 1,5-dimethyl tetralin; partially hydrogenated terphenyl, such as Cargille® 5040; phenylmethylsiloxane oligomer; and combinations thereof. A most preferred composition for the encapsulated fluid according to an embodiment of the present invention comprises cyclododecatriene and a partially hydrogenated terphenyl.

Electrophoretic media comprising microcapsules also generally include a binder to assist in the coating of the electrophoretic media onto a substrate. A mixture of fish gelatin and a polyanion, such as acacia has been found to be an excellent binder for use with capsules formed from a coacervate of (pig) gelatin and acacia. Polyanions that may be included in the binder with fish gelatin include, but are not limited to, carbohydrate polymers, such as starch and cellulose derivatives, plant extracts (e.g. acacia), and polysaccharides (e.g. alginate); proteins, such as gelatin or whey protein; lipids, such as waxes or phospholipids; and combinations thereof.

The gelatin-based capsule walls have been described in many of the E Ink and MIT patents and applications mentioned above. The gelatin is available from various commercial suppliers, such as Sigma Aldrich or Gelitia USA. It can be obtained in a variety of grades and purity depending upon the needs of the application. Gelatin primarily comprises collagen that has been collected from animal products (cow, pig, poultry, fish) and hydrolyzed. It comprises a mixture of peptides and proteins. In many of the embodiments described herein, the gelatin is combined with acacia (gum arabic), which is derived from the hardened sap of the acacia tree. Acacia is a complex mixture of glycoproteins and polysaccharides, and it is often used as a stabilizer in food stuffs. The pH of aqueous solutions of acacia and gelatin can be tuned to form a polymer-rich coacervate phase that can encapsulate droplets of a non-polar internal phase.

Capsules incorporating gelatin/acacia may be prepared as follows; see, for example U.S. Pat. No. 7,170,670, incorporated by reference in its entirety. In this process, an aqueous mixture of gelatin and/or acacia is emulsified with a hydrocarbon internal phase (or other water-immiscible phase which it is desired to encapsulate) to encapsulate the internal phase. The solution may be heated to 40° C. prior to emulsification—to dissolve the gelatin. The pH is typically lowered to form a coacervate after the desired drop size distribution is achieved. Capsules are formed upon controlled cooling and mixing of the emulsion—typically to room temperature or lower. Proper mixing and certain encapsulation formulations (e.g. gelatin & acacia concentrations & pH) to discretely gel the coacervate around the internal phase droplets in a uniform manner are achieved if the wetting and spreading conditions are correct, which is largely dictated by the internal phase composition. The process yields capsules in the range of 20-100 m and often incorporates over 50 percent of the starting materials into useable capsules. The capsules produced are then separated by size by sieving or other size exclusion sorting.

The manufacture of a multi-layer variable transmissive film normally involves at least one lamination operation. For example, in several of the aforementioned MIT and E Ink patents and applications, there is described a process in which an encapsulated electrophoretic medium comprising capsules in a binder is coated on to a flexible substrate comprising indium-tin-oxide (ITO) or a similar conductive coating (which acts as one electrode of the final display) on a plastic film, the capsules/binder coating being dried to form a coherent layer of the electrophoretic medium firmly adhered to the substrate. Separately, a backplane, containing an array of pixel electrodes and an appropriate arrangement of conductors to connect the pixel electrodes to drive circuitry, is prepared. To form the final device, the substrate having the capsule/binder layer thereon is laminated to the backplane using a lamination adhesive. In one preferred form of such a process, the backplane is itself flexible and is prepared by printing the electrodes and conductors on a plastic film or other flexible substrate. The obvious lamination technique for mass production of displays by this process is roll lamination using a lamination adhesive.

The aforementioned U.S. Pat. No. 6,982,178 describes a method of assembling a solid electro-optic display (including an encapsulated electrophoretic display) which is well adapted for mass production. Essentially, this patent describes a so-called "front plane laminate" ("FPL") which comprises, in order, a light-transmissive electrically-conductive layer; a layer of a solid electro-optic medium in electrical contact with the electrically-conductive layer; an adhesive layer; and a release sheet. Typically, the light-transmissive electrically-conductive layer will be carried on a light-transmissive substrate, which is preferably flexible, in the sense that the substrate can be manually wrapped around a drum (say) 10 inches (254 mm) in diameter without permanent deformation. The substrate will typically be a polymeric film, and will normally have a thickness in the range of about 1 to about 25 mil (25 to 634 μm), preferably about 2 to about 10 mil (51 to 254 μm). The electrically-conductive layer is conveniently a thin metal or metal oxide layer of, for example, aluminum or ITO, or may be a conductive polymer. Poly(ethylene terephthalate) (PET) films coated with aluminum or ITO are available commercially, for example as "aluminized Mylar" ("Mylar" is a Registered Trade Mark) from E.I. du Pont de Nemours & Company, Wilmington Del., and such commercial materials may be used with good results in the front plane laminate.

Assembly of an electro-optic display using such a front plane laminate may be effected by removing the release sheet from the front plane laminate and contacting the adhesive layer with the backplane under conditions effective to cause the adhesive layer to adhere to the backplane, thereby securing the adhesive layer, layer of electro-optic medium and electrically-conductive layer to the backplane. This process is well-adapted to mass production since the front plane laminate may be mass produced, typically using roll-to-roll coating techniques, and then cut into pieces of any size needed for use with specific backplanes.

U.S. Pat. No. 7,561,324 describes a so-called "double release sheet" which is essentially a simplified version of the front plane laminate of the aforementioned U.S. Pat. No. 6,982,178. One form of the double release sheet comprises a layer of a solid electro-optic medium sandwiched between two adhesive layers, one or both of the adhesive layers being covered by a release sheet. Another form of the double release sheet comprises a layer of a solid electro-optic medium sandwiched between two release sheets. Both forms of the double release film are intended for use in a process generally similar to the process for assembling an electro-optic display from a front plane laminate already described, but involving two separate laminations; typically, in a first lamination the double release sheet is laminated to a front electrode to form a front sub-assembly, and then in a second lamination the front sub-assembly is laminated to a backplane to form the final display, although the order of these two laminations could be reversed if desired.

U.S. Pat. No. 7,839,564 describes a so-called "inverted front plane laminate", which is a variant of the front plane laminate described in the aforementioned U.S. Pat. No. 6,982,178. This inverted front plane laminate comprises, in order, at least one of a light-transmissive protective layer and a light-transmissive electrically-conductive layer; an adhesive layer; a layer of a solid electro-optic medium; and a release sheet. This inverted front plane laminate is used to form an electro-optic device having a layer of lamination adhesive between the electro-optic layer and the front electrode or front substrate; a second, typically thin layer of adhesive may or may not be present between the electro-optic layer and a backplane.

The lamination adhesive, such as layer 32 in FIGS. 2 and 3, may be present between any of the layers of the variable transmissive film, and the presence of this lamination adhesive layer affects the electro-optic characteristics of the displays. In particular, the electrical conductivity of the lamination adhesive layer affects both the low temperature performance of the film. The low temperature performance can (it has been found empirically) be improved by increasing the conductivity of the lamination adhesive layer, for example by doping the layer with tetrabutylammonium hexafluorophosphate or other materials as described in the aforementioned U.S. Pat. Nos. 7,012,735 and 7,173,752.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

All of the contents of the aforementioned patents and applications are incorporated by reference herein in their entireties.

We claim:

1. A lamp comprising:

a variable transmissive film including, a first light-transmissive electrode, a second light-transmissive electrode, and an encapsulated bistable electrophoretic dispersion containing a plurality of electrically charged particles and a fluid, wherein the encapsulated bistable electrophoretic dispersion is disposed between the first light-transmissive electrode and the second light-transmissive electrode, wherein the electrically charged particles move toward the first light-transmissive electrode or the second light-transmissive electrode when an electric field is provided between the first light-transmissive electrode and the second light-transmissive electrode, wherein the encapsulated bistable electrophoretic dispersion is capable of being electrically switched by the electric field between an open, light-transmissive state and a dispersed, light-diffusing state, and wherein, after being switched, the encapsulated bistable electrophoretic dispersion maintains the open, light-transmissive state or the dispersed, light-diffusing state without the electric field being provided for a length of time at least four times as long as the duration of the electric field required to switch the encapsulated bistable electrophoretic dispersion between the open, light-transmissive state and the dispersed, light-diffusing state;

a light source arranged to transmit light through the variable transmissive film; and a controller to modify the electric field provided between the first light-transmissive electrode and the second light-transmissive electrode.

2. The lamp of claim 1 further comprising a power source electrically connected to the light source and the variable transmissive film.

3. The lamp of claim 1, wherein the bistable electrophoretic dispersion is encapsulated within a plurality of capsules.

4. The lamp of claim 1, wherein the variable transmissive film further comprises a polymeric sheet comprising a plurality of sealed microcells, and the bistable electrophoretic dispersion is encapsulated within the plurality of sealed microcells.

5. The lamp of claim 1, wherein the variable transmissive film further comprises a continuous polymeric phase, and the bistable electrophoretic dispersion is provided in a plurality of droplets encapsulated in the continuous polymeric phase.

6. The lamp of claim 1, wherein the variable transmissive film further comprises a curved substrate and the encapsulated bistable electrophoretic dispersion is applied to a surface of the curved substrate.

7. The lamp of claim 1, wherein the electrically charged particles are white.

8. The lamp of claim 1, wherein the first or the second light-transmissive electrode comprises a plurality of independently controllable electrodes.

9. The lamp of claim 8, wherein the first and the second light-transmissive electrodes comprise perpendicular conductive strips and create a passive matrix of light-transmissive pixels.

10. The lamp of claim 1, wherein the controller is configured to provide a time-dependent voltage waveform to the first light-transmissive electrode or the second light-transmissive electrode.

11. The lamp of claim 10, wherein the controller is configured to provide a time-dependent voltage waveform between a first end of the first light-transmissive electrode and a second end of the first light-transmissive electrode.

12. The lamp of claim 1, wherein the variable transmission film is coupled to the light source with an adhesive.

* * * * *